US006385322B1

(12) United States Patent
Mietling

(10) Patent No.: US 6,385,322 B1
(45) Date of Patent: May 7, 2002

(54) METHOD AND DEVICE FOR OPERATION OF A PUBLIC ADDRESS (ACOUSTIC IRRADIATION) SYSTEM

(75) Inventor: Andreas Mietling, Rudersberg (DE)

(73) Assignee: d & b audiotechnik Aktiengesellschaft, Backnang (DE)

( * ) Notice: Subject to any disclaimer, the term of this patent is extended or adjusted under 35 U.S.C. 154(b) by 0 days.

(21) Appl. No.: 09/096,691

(22) Filed: Jun. 12, 1998

(30) Foreign Application Priority Data

Jun. 20, 1997 (DE) ..... 197 26 176

(51) Int. Cl.[7] ..... H04R 27/00; H04R 29/00
(52) U.S. Cl. ..... 381/82; 381/59
(58) Field of Search ..... 381/82, 58, 59, 381/120, 96, 77, 84, 85

(56) References Cited

U.S. PATENT DOCUMENTS

| | | | | | |
|---|---|---|---|---|---|
| 4,636,740 | A | * | 1/1987 | Kager | 330/123 |
| 5,014,320 | A | * | 5/1991 | Nagi et al. | 381/96 |
| 5,031,221 | A | * | 7/1991 | Yokoyama | 381/96 |
| 5,042,070 | A | * | 8/1991 | Linna et al. | 381/59 |
| 5,406,634 | A | * | 4/1995 | Anderson et al. | 381/82 |
| 5,430,802 | A | * | 7/1995 | Page | 381/96 |
| 5,450,624 | A | | 9/1995 | Porambo et al. | 455/226.4 |
| 5,581,626 | A | * | 12/1996 | Palmer | 381/103 |
| 5,881,103 | A | * | 3/1999 | Wong et al. | 375/229 |

FOREIGN PATENT DOCUMENTS

| | | | |
|---|---|---|---|
| DE | 41 00 848 A1 | 7/1992 | H04R/3/04 |
| EP | 0 479 456 B1 | 12/1995 | H03G/3/00 |
| GB | 2 123 193 A | 1/1984 | H04R/27/00 |
| JP | 1-213099 | 8/1989 | H04R/5/04 |

OTHER PUBLICATIONS

Patent Abstracts of Japan, EPO, vol. 11, No. 110(D–496), Apr. 7, 1987; Abstract entitled "Acoustic Control Device", Publication No. JP 61 257099A, published Nov. 14, 1986 (1page).

European Patent Office Search Report dated Jul. 3, 2000, for EP 98 10 8014 (3 pages).

* cited by examiner

*Primary Examiner*—Xu Mei
(74) *Attorney, Agent, or Firm*—Fitch, Even, Tabin & Flannery

(57) ABSTRACT

The invention pertains to a method and a device for operation of a public address system with at least one loudspeaker box and with at least one amplifier, which is connected by means of a preferably detachable cable connection and/or by means of a non-cable-based connection, to the loudspeaker box, characterized in that in a first process step, the amplifier receives data pertaining to acoustical and/or electrical parameters of the loudspeaker box by inquiry of the loudspeaker box, and that in a second process step, the amplifier is configured automatically, under consideration of the data/parameters, for operation with the connected loudspeaker box.

17 Claims, 2 Drawing Sheets

METHOD AND DEVICE FOR OPERATION OF A PUBLIC ADDRESS (ACOUSTIC IRRADIATION) SYSTEM

BACKGROUND OF THE INVENTION

The invention pertains to a method for operation of a public address system with at least one loudspeaker box and with at least one amplifier, which is connected by means of a preferably detachable cable connection and/or by means of a noncable-based connection, to the loudspeaker box.

Public address systems are often set up for the sole purpose of implementing a concert, for example, to provide sound to a concert hall or festival grounds, etc. Since in this case, we are dealing with a mobile system, the loudspeaker box and amplifier are connected to each other by means of a detachable cable connection. Often several amplifiers and several loudspeaker boxes are available, where both the amplifier and the loudspeaker boxes are not identical, but rather are of different models, that is, the single amplifiers have different electrical properties and the loudspeaker boxes have different acoustical, and/or electrical parameters. For this reason it is entirely possible that one and the same amplifier at a first concert, will be working together with type A loudspeaker boxes, and that in an additional, subsequent concert, type B loudspeaker boxes will be connected to said amplifier. Furthermore, it is also possible that at a third concert, both the type A loudspeaker and also the type B loudspeaker will be operating together with the stated amplifier, for example, in a parallel connection. The result of this continually increasing build-up of the public address system is that optimum conditions are not always achieved with regard to a coordination of the amplifier with the loudspeaker boxes, both with regard to electrical circuitry and also with regard to acoustics.

Therefore the invention is based on the problem of specifying a method for operation of a mobile or fixed-site public address system, which always results in a preferred system, in spite of differing combinations of amplifiers and loudspeaker boxes, and without any complicated activities having to be undertaken.

SUMMARY OF THE INVENTION

This problem is solved according to this invention, in that in a first process step, the amplifier receives data pertaining to acoustical and/or electrical parameters of the loudspeaker box by inquiry of the loudspeaker box, and that in a second process step, the amplifier is configured automatically, under consideration of the data/parameters, for operation with the connected loudspeaker box. Thus the invention is based on the principle that an automatic configuration will occur, depending on the connected loudspeaker box, that is, due to the automatically occurring ascertainment of parameters, the properties of the public address system are optimized preferably in the electrical and also in the electroacoustical field, in such a manner that the best-possible results can be achieved. The term "amplifier" in the present case is understood to be a device that allows not only an amplification, but rather also can affect the transient response by means of a signal processing unit.

According to one embodiment of the invention, the configuration is performed with regard to the transient response, in particular with regard to the frequency response and/or phase response. In this regard, the data supplied from the loudspeaker box is evaluated by a controller of the amplifier with regard to an optimized frequency response and subsequently the amplifier will be adjusted by the controller to the parameters of the loudspeaker box in a manner already disclosed to an ordinary technician skilled in the art, so that the desired frequency response will be achieved.

Furthermore, it is an advantage if the configuration is performed with regard to power-handling capacity. Thus, for example, if a loudspeaker box is connected to the amplifier which has only a limited power-handling capacity, that is, if there is a danger, for example, that the very-high-power amplifier might cause damage to or destruction of the loudspeaker box at a corresponding output power, then the configuration can take place in such a manner that operation of the loudspeaker box takes place only up to a limiting power-handling capacity which will preclude any damage.

According to yet another embodiment of the invention, it is possible that the configuration takes place with regard to spatial acoustics—loudspeaker arrangement in the case of several loudspeakers (array formation)—with regard to its use with or without a subwoofer and/or user-specific tone settings.

According to another embodiment of the invention, it is preferable that the configuration takes place under consideration of the changing properties of the loudspeaker box over the course of its aging and/or under consideration of individual properties of the loudspeaker box for example, for tolerance compensation of a single chassis. In this regard, a time-dependent configuration will be produced, that is, upon connection of the loudspeaker box to the amplifier, data will be transmitted along the cable connection which provides information about the age or about the hours of operation already handled by the loudspeaker box. Since the parameters, for example, the sound behavior of the loudspeaker box, change over the course of its aging, then a compensation for this change is possible by means of the configuration. These time-dependent parameters pertain to changes in the acoustical reproduction properties, the electrical properties and/or the magnetic properties. In the case of a configuration as a function of individual properties of the loudspeaker, production control of the individual components of the loudspeaker box can be corrected and thus a consistent quality can be achieved in a simple manner.

According to an aspect of the invention, during the configuration, a check is made to determine whether operation with several loudspeaker boxes is possible/occurring. If this should happen to be the case, then the amplifier receives corresponding data, for example, that two loudspeaker boxes of the same or different type are connected to the amplifier in parallel operation. Now the amplifier will check, based on the data transferred to it, whether this parallel connection of the two boxes is possible, that is, whether an operation can occur without the amplifier itself or the loudspeaker boxes being endangered and whether the operation will lead to satisfactory electrical/electro acoustical results. The same is also true for a series connection of two or more loudspeaker boxes. In this particular case, the amplifier can only be informed by manual input, of whether we are dealing with a parallel or a series connection or with a mixed circuit, for example, the parallel connection of two boxes, for which a third box is wired in series. However, a recognition of this kind can also take place automatically, if for example, an impedance check is performed by the amplifier and at the same time, data is provided that refer to the used loudspeaker boxes. Knowledge of the specifically used loudspeaker boxes, in association with the impedance, will allow the amplifier to decide by itself, whether a parallel or series connection is present.

Furthermore, the invention pertains to a device,for operation of a public address system which has at least one loudspeaker box and one amplifier which is connected by means of a detachable cable connection to the loudspeaker box, and an electrical configuration circuit. The configuration circuit receives data from the loudspeaker box pertaining to its acoustical and/or electrical parameters, said data being supplied preferably by means of the cable connection, and that the configuration circuit automatically configures the public address system , under consideration of the data/parameters, for operation with the connected loudspeaker box. The configuration circuit can be a constituent of the amplifier, that is, a specific assembly of the amplifier, but it is also possible to design this configuration circuit as a separate circuit and to place it in the same housing of the amplifier or in an additional housing. The configuration circuit is in a position to evaluate the data coming from the loudspeaker box and to exert an associated influence, meaning in an electrical regard, on the amplifier and/or on an electronic signal processing unit, which can also be a constituent of the amplifier, but need not be so, and thus the stated optimizing of the public address system is possible.

Furthermore, it is an advantage that the cable connection has a loudspeaker cable and a data cable. In this case, the low-frequency cable is electrically separated from the data cable for driving of the loudspeaker. This does not mean that two separate cables have to be laid, but rather it is entirely possible that the electrical conductors of the loudspeaker cable and data cable are surrounded by a common mantle. But as an alternative, it is also possible that the cable connection is a loudspeaker cable along which the data is also transmitted. In this case, one and the same electrical line can be used for the data transmission and for driving of the loudspeaker. Preferably in the latter case, a time-sharing operation will be carried out, that is, the configuration takes place at a time when no driver data is being transmitted for the loudspeaker and vice-versa. Due to corresponding switching gear, which can be of an electromechanical or also of an electronic nature, this required reverse switching can be implemented, namely from operation of the loudspeaker for acoustic irradiation, to operation for transmission of data or vice-versa.

The data can be transferred along an electrical or optical cable (the latter is called a fiberoptic cable) or by wireless transmission. Suitable for wireless transmission, in particular, is infrared, radio or ultrasonic transmission.

Furthermore, it is an advantage for the loudspeaker box to have an electrical memory unit which supplies the data. The memory unit contains information about the properties of the loudspeaker box, about the type of loudspeaker box, about the serial number of the loudspeaker box, about the hours of operation of the loudspeaker box, about electrotechnical and/or acoustic parameters of the loudspeaker box and/or about possible service instructions on the operation of the loudspeaker box. The above enumeration is not comprehensive, but rather additional data can be saved in the referenced memory. Overall it is thus clear that the memory content pertains to information specific to the loudspeaker and after it is inquired up by the amplifier or rather, by the configuration circuit, it can mean that the configuration can be carried out, that is, that the amplifier is coordinated to the particular, connected loudspeaker box. The amplifier can be designed preferably as a power-handling amplifier. In addition or as an alternative, it is possible that an audio processor is applied to it.

The discussion above and also the discussion below, pertain solely to one channel of the public address system, for example, to the right channel, when a stereo public address system consisting of a right and a left channel is being used. This discussion applies to all channels of the public address system, for example, to the left channel or to additional channels in the case of multichannel systems, such as surround-sound systems or stage monitor systems, for instance. Of course, it is also possible that the memory unit will have information about so-called DSP programs (digital-signal processor programs), whereby the resultant information likewise can be taken into account in the configuration of the amplifier.

BRIEF DESCRIPTION OF THE DRAWINGS

The figures will illustrate the invention in greater detail, based on the design examples; specifically we have.

DESCRIPTION

Figure 1:
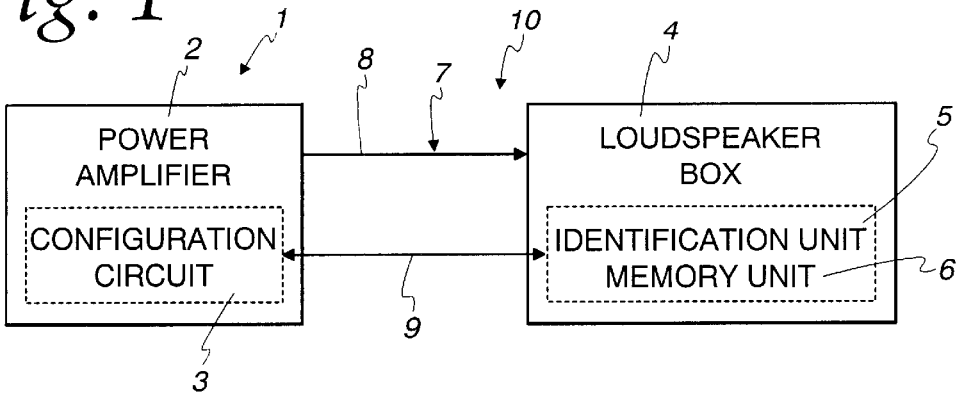
FIG. 1: A block diagram of a public address system which consists of an amplifier and a loudspeaker box

FIG. 1 presents a schematic illustration that shows an amplifier 1, which is designed as a power amplifier 2, and to which a configuration circuit 3 is applied. Reference number 4 denotes a loudspeaker box that has an applied identification unit 5, which is formed by a memory unit 6. By means of a cable connection 7, the loudspeaker box 4 is connected with the amplifier 1, whereby the cable connection 7 consists of a loudspeaker cable 8 and a data transmission path 9. From the direction of the arrow it is evident that for operation of the loudspeaker box 4, corresponding signals are transferred from the amplifier 1 to the loudspeaker box 4. The data transmission path 9 is equipped with double arrows which indicates that a data exchange occurs, in particular, this data exchange occurs between the configuration circuit 3 and the memory unit 6.

Figure 2:
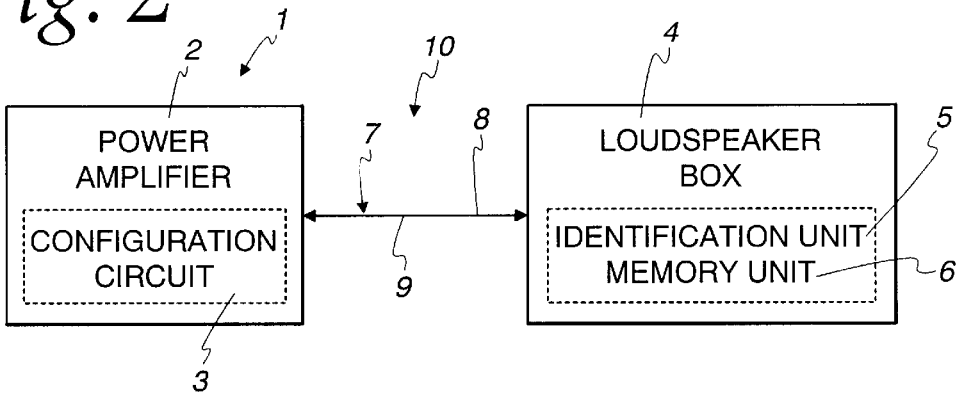
FIG. 2: An additional example of a public address system

FIG. 2 shows a public address system 10 in which the components of amplifier 1 and of the loudspeaker box 4 correspond to the preceding discussion on the example of FIG. 1, so that we will discuss only the cable connection 7 here, which passes both the electrical signals for operation of the loudspeaker box 4 from the amplifier 1 to said loudspeaker box 4, and also performs the data transmission, e.g., it thus also forms the data transmission path 9. The functioning of the public address system 10 according to FIG. 2 will be discussed in greater detail below.

Figure 3:
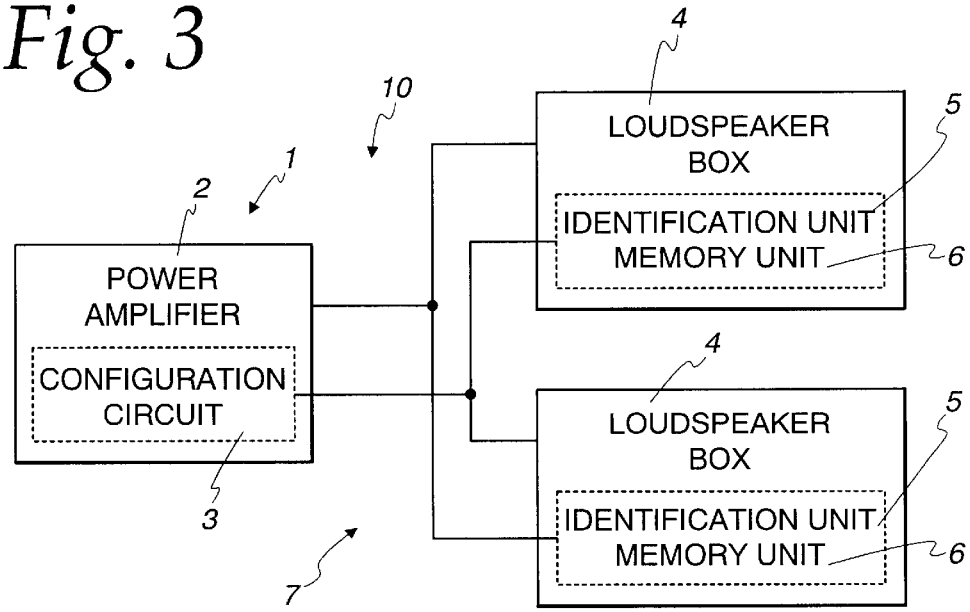
FIG. 3: A public address system according to another design example.

FIG. 3 shows an additional example of a public address system 10, in which several loudspeaker boxes 4 are applied to the amplifier 1, whereby two loudspeaker boxes 4 are illustrated as an example in FIG. 3. Basically, however, it is also possible to apply more than two loudspeaker boxes 4 to the amplifier 1. Each loudspeaker box 4 has an identification unit 5, which is formed as a memory unit 6. Based on the cable connection 7 visible in FIG. 3, it is clear that the two loudspeaker boxes 4 are operated in parallel connection with the amplifier 1.

The following function is obtained for the example in FIG. 1. First, the amplifier 1 is switched on, whereby by means of the data transmission path, a supply voltage is sent to the identification unit 5. In this case, no pure data transmission is occurring on the data transmission path 9, but rather in the case presented here, in addition to connections for the data transmission, electrical supply lines are also provided. Next, a queuing operation occurs, that is, the identification unit 5 is ready for reception and waits for a communications prompt from the configuration circuit 3 of the power amplifier 2. The power amplifier 2 then sends out a communications prompt which is received by the identification unit 6 via the data transmission path 9. This communications prompt includes a request to send certain requested data. In this regard, in an additional step, the memory unit is read out in a search for the requested data, that is, the identification unit 5 sends the requested data to the configuration circuit 3 via the data transmission path 9. This transmission can occur in several cycles, that is, after a particular prompt, the response then follows, but it is also possible first to send several prompts and then to transmit the responses together. Once the configuration circuit 3 has received the desired data, then the circuit will have information about the parameters of the loudspeaker box, so that then by means of the configuration circuit 3, a change can be made to the power amplifier 2 in such a manner that its parameters can be adapted to the loudspeaker box 4 specifically connected in this case, so that a desired optimizing will occur, for example, with regard to electrical and/or acoustic factors.

In the example in FIG. 2 we proceed in a similar manner, with the difference that due to the combined cable connection 7, this cable connection is first used for the configuration mode and that subsequently a reverse switching takes place in order to connect the low-frequency output of the amplifier 3 to the loudspeakers of the loudspeaker box 4. In this case, we can even proceed in that during the transmission of the supply voltage from the amplifier 1 to the identification unit 5, the data are also transmitted along the same cable, since by means of an appropriate electronic unit, it will be readily possible per se to separate the operating voltage from the data unit.

The example of FIG. 3 indicates the parallel operation of two loudspeaker boxes. If this parallel operation is recognized—which will be discussed in greater detail below—then the configuration circuit 3 of the power amplifier 2 checks whether a parallel operation of these two loudspeaker boxes 4 can occur on this amplifier 1, without there being any damage to amplifier 1 and/or to loudspeaker boxes 4, and if necessary, whether the configuration used in this case can satisfy the electroacoustical requirements. If this question is decided positively, then the operation will begin after carrying out the configuration. But ifs it turns out after the check that a parallel operation does not seem advisable, then in the configuration circuit 3 this leads to a corresponding signal that blocks the operation of the amplifier 1. In this manner, damage will be prevented, or less than optimum electroacoustical results will be prevented.

Figure 4:
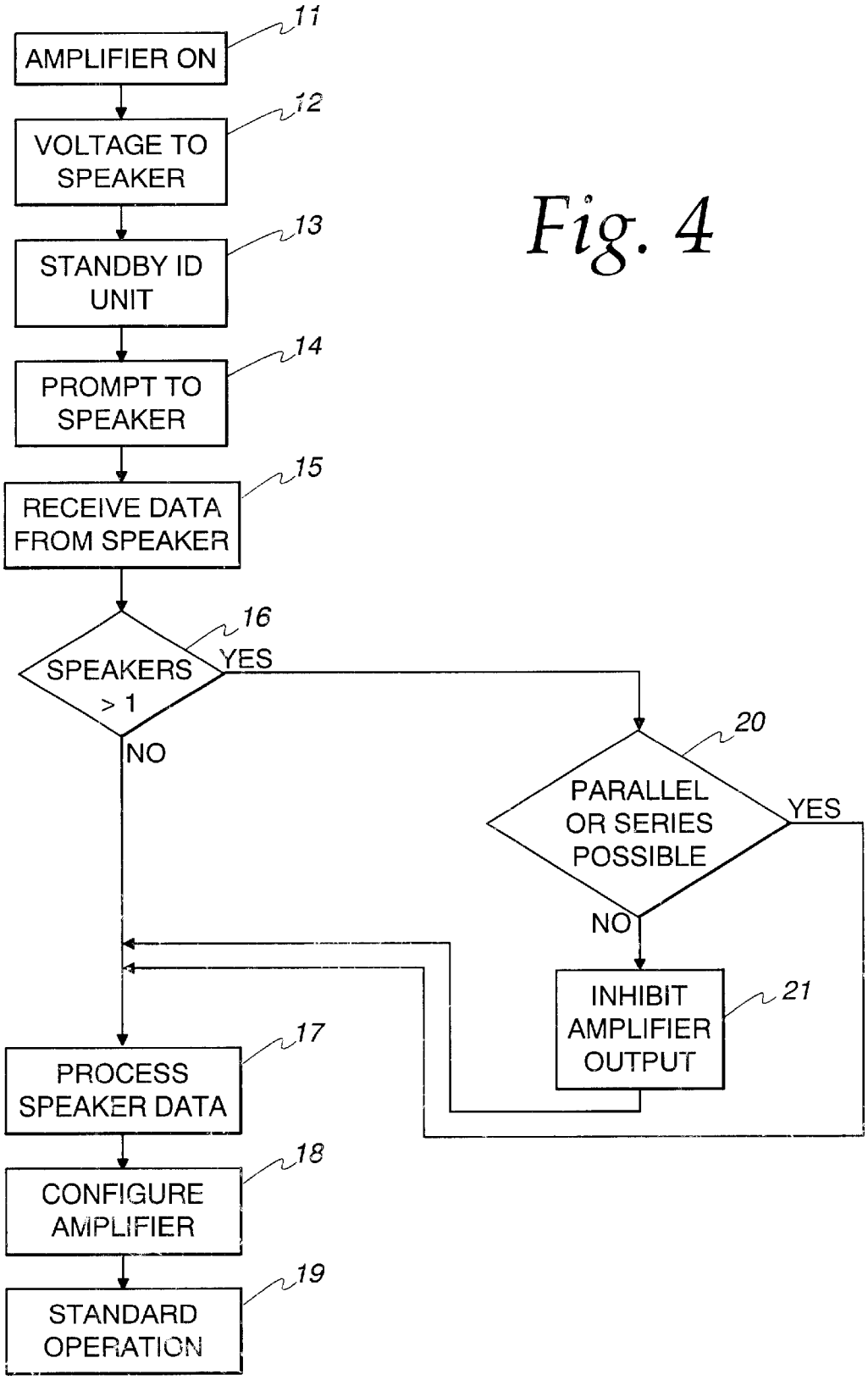
FIG. 4: A flow chart that illustrates the method according to this invention.

FIG. 4 illustrates the foregoing based on a flow chart. In field 11 the amplifier 1 is switched on. Field 12 illustrates that a supply voltage is sent from the amplifier 1 of the identification unit 5 to the loudspeaker box 4. Field 13 shows that the identification unit 5 is in stand-by mode, that is, it waits for a communications prompt from the configuration circuit 3. Field 14 indicates that a communication takes place, that is, that the identification unit 5 receives the communication prompt of the configuration circuit 3. Subsequently, data is then transferred from the memory unit 6 to the configuration circuit 3—according to field 15—based on the communication prompt. In decision field 16, a check is made of whether one or several loudspeaker boxes 4 are connected to the amplifier 1. In FIG. 4, Y stands for yes, and n stands for no. If only one loudspeaker box 4 is connected, then according to field 17, a processing of the corresponding data takes place which were transferred from the identification unit 5 to the configuration circuit 3. In field 18, based on the results of the received data, the configuration of the power amplifier 2 is performed. Once this configuration is made, in field 19 the "standard operation" of the public address system 10 will begin, that is, the data transmission is concluded and now the loudspeaker of the loudspeaker box 4 can be driven by means of the amplifier 1. If several loudspeaker boxes 4 are connected to the amplifier 2, then in field 20 a check is made to determine whether, for example, a parallel operation or a series operation is possible. If this possibility exists, then the system moves forward to field 17, etc. But if this possibility does not exist due to electrical or electroacoustical conditions, then in field 21 a blocking of the loudspeaker output of the amplifier 1 will occur, that is, no operation of this combination of the public address system 10 will be possible.

The invention thus pertains to a self-actuated determination of the parameters of the public address system , for example, with regard to the transmission behavior of this system. As a whole, in the checking and configuration, a sequence control is provided, where particular data characterizing the loudspeaker box is read out from a nonvolatile memory medium, namely the memory unit 6 mentioned above, and is transferred along the data transmission path 9 of the configuration circuit 3. By means of the invention, an adaptation occurs with regard to different model classes of the power amplifier-audio processor combinations and/or loudspeaker box combinations, whereby in the above-mentioned data exchange, differing data sets are transferred, for example, consisting of model and serial numbers. For example, if a model and/or serial number is transferred from the memory unit 6 to the configuration circuit 3, then based on data saved in the configuration circuit 3, conclusions will be drawn about the parameters of the loudspeaker box. These data are then available for the configuration. The data sets for definition of parameters of an optimized loudspeaker operation can pertain, for example, to the frequency response, to power-handling tables, to DSP programs, etc. Furthermore, it is also possible that so-called logbook entries on the operating data of the loudspeaker box will be transferred, for example, data on an hours of operation counter, on the date, on clock time, service commentary on the loudspeaker box, etc., whereby all data or a portion thereof can be used in the configuration. The data transmission can be performed, in particular, according to the known serial data transfer topologies, as are found, for example, in the computer engineering as well. It is also possible to perform a wireless data transfer, instead of the wire-based data transfer, for example, by means of infrared data transmission. Overall it is clear that the single functional groups, namely the configuration circuit 3 and also the identification unit 5, can have components for read/write and that corresponding interfaces are provided for signal transmission. Furthermore, a corresponding sequence control is necessary in order to perform the parameterizing—according to the functional sequence of FIG. 4. Now the amplifier can be a so-called power amplifier-audio processor combination—as mentioned already—whereby the audio processor pertains to a device or to a system for linear and/or nonlinear audio signal processing. The linear audio signal processing pertains to a so-called equalizer, for example, and a nonlinear audio signal processing can use a so-called limiter. According to additional examples, the supply voltage for the identification unit can also be obtained from the low frequency signal of the loudspeaker. It is also possible to use a battery. Furthermore, during loudspeaker operation, an identification query can be carried out, in particular cyclically, in order to take account, automatically, of possible changes to the system, for example, the switching on of an additional loudspeaker.

What is claimed is:

1. A method for operation of a public address system comprising at least one loudspeaker box remote from and electrically connected to at least one amplifier, the method comprising:

storing data in a memory unit at the loudspeaker box, in particular an electrical and/or optical memory unit, pertaining to the loudspeaker's acoustical and electrical parameters;

sending an inquiry from the amplifier to the loudspeaker box requesting the data from the memory unit;

receiving, by the amplifier, the data requested from the memory unit of the loudspeaker box pertaining to the acoustical and electrical parameters of the loudspeaker box; and automatically configuring the amplifier in accordance with the data received from the memory unit of the loudspeaker box for operation with the loudspeaker.

2. A method according to claim 1, wherein the configuring step comprises configuring the amplifier in accordance with a transient response, in particular with regard to a frequency response and/or phase response of the loudspeaker box.

3. A method according to claim 1, comprising configuring the amplifier to provide operation of amplifier-loudspeaker combination within power-handling limits.

4. A method according to claim 1, wherein the receiving step comprises receiving data pertaining to acoustical and electrical parameters of a plurality of loudspeaker boxes and the method comprises configuring the amplifier according to spatial acoustics, with regard to its use with or without a subwoofer and/or user-specific tone settings.

5. A method according to claim 1, wherein the configuration step comprises configuring the amplifier in accordance with changing properties of the loudspeaker box over the course of its aging and/or under consideration of individual properties of the loudspeaker box.

6. A method according to claim 1, comprising checking to determine whether operation with several loudspeaker boxes is possible/occurring.

7. A method according to claim 6, comprising disabling the amplifier if electrical and acoustical parameters of the plurality of loudspeakers exceed power-handling capacity of the amplifier.

8. A method according to claim 1, further comprising limiting power output of the amplifier in accordance with power-handling capacity of the loudspeaker box.

9. A method according to claim 8, wherein the amplifier is automatically shut down when the power output of the amplifier exceeds the power-handling capacity of the loudspeaker box.

10. A method according to claim 1, comprising disabling the amplifier if electrical and acoustical parameters of the loudspeaker exceed power-handling capacity of the amplifier.

11. A public address system, comprising:

a loudspeaker box comprising an identification unit comprising a memory unit, in particular an electrical and/or optical memory unit, for storing data pertaining to acoustical and electrical parameters of the loudspeaker box comprising the memory unit;

an amplifier arrangement, remote from and electrically connected to the loudspeaker box for reading the data from the memory unit of the loudspeaker box; and a configuration circuit of the amplifier arrangement responsive to the data from the memory unit of the loudspeaker box for automatically configuring the public address system in accordance with the data read from the memory unit of the loudspeaker box.

12. A public address system according to claim 11, wherein the connection between the amplifier arrangement and the loudspeaker box comprises a loudspeaker cable for driving a sound transducer and a data transmission path.

13. A public address system according to claim 11, wherein the connection between the amplifier arrangement and the loudspeaker box comprises a loudspeaker cable along which the data is also transmitted.

14. A public address system according to claim 11, wherein the identification unit stores: model and/or serial number of the loudspeaker box, and/or data which permit a satisfactory identification of the loudspeaker box, and operating data on the loudspeaker box, and electrical parameters of the loudspeaker box, and acoustical parameters of the loudspeaker box, and/or service commentary on the loudspeaker box, and/or spatial acoustical parameters, and parameters regarding the loudspeaker arrangement in the case of several loudspeakers, and/or parameters regarding its use with or without a subwoofer and/or user-specific tone settings.

15. A public address system according to claim 1, wherein the amplifier arrangement comprises a power amplifier.

16. A public address system according to claim 15, wherein the configuration circuit of the amplifier arrangement provides operation of amplifier-loudspeaker combination within power-handling limits.

17. A public address system according to claim 11, wherein the amplifier arrangement comprises an audio processor.

* * * * *